US005660120A

United States Patent [19]

Sims

[11] Patent Number: 5,660,120

[45] Date of Patent: Aug. 26, 1997

[54] MODULAR FURNITURE

[75] Inventor: John Sims, London, United Kingdom

[73] Assignee: Ergonomic Workstations Limited, High Wycombe, United Kingdom

[21] Appl. No.: 389,194

[22] Filed: Feb. 15, 1995

[51] Int. Cl.[6] ..... A47B 57/00

[52] U.S. Cl. ..... 108/60; 312/223.6; 49/70; 108/50; 52/239

[58] Field of Search ..... 312/196, 223.1, 312/223.3, 223.4, 223.6; 108/23, 50, 152, 153, 60; 52/220.7, 239, 731.4, 731.5; 49/70, 463; 174/49, 65 R

[56] References Cited

U.S. PATENT DOCUMENTS

| | | | |
|---|---|---|---|
| 4,092,486 | 5/1978 | Myers . | |
| 4,252,989 | 2/1981 | Blumenthal . | |
| 4,295,673 | 10/1981 | Miller . | |
| 4,353,411 | 10/1982 | Harter et al. | 52/220.7 |
| 4,600,254 | 7/1986 | Whalen . | |
| 4,807,331 | 2/1989 | Calucci . | |
| 4,974,915 | 12/1990 | Bussard | 108/50 |
| 4,986,194 | 1/1991 | Bollman | 108/60 |
| 5,044,135 | 9/1991 | Kroon et al. | 108/60 |
| 5,065,832 | 11/1991 | Mark | 108/50 |
| 5,231,562 | 7/1993 | Pierce et al. | 174/48 |

FOREIGN PATENT DOCUMENTS

| | | | |
|---|---|---|---|
| 0514862A | 11/1992 | European Pat. Off. . | |
| 2144810 | 3/1973 | Germany | 174/48 |
| 2039643 | 12/1994 | United Kingdom . | |
| WO81/02495A | 9/1981 | WIPO . | |

OTHER PUBLICATIONS

Wall Ducts; Multi–Outlet Poles, Van Geel Systems, Trade Catalogue, 1989, pp. 23, 30 and 37.

Cable Management by Marshall–Tufflex, Trade Catalogue, 1992, pp. 18 to 20.

*Primary Examiner*—Peter M. Cuomo
*Assistant Examiner*—Hanh V. Tran
*Attorney, Agent, or Firm*—Jacobson, Price, Holman & Stern, PLLC

[57] ABSTRACT

A modular furniture system for open-plan offices includes a cable tower unit, a plurality of panel screens which are attachable to and detachable from the cable tower unit and a workstation surface. Adjacent panel screens define a workstation area when they are attached to the cable tower unit into which the workstation surface is moveable. The workstation surface is free-standing from the cable tower unit and the panel screens. In a further embodiment, two cable tower units may be attached together through their respective rear faces to form a single cable tower unit having four workstation areas.

12 Claims, 5 Drawing Sheets

MODULAR FURNITURE

FIELD OF THE INVENTION

The present invention relates to modular furniture for an open-plan office in which individual workstations are separated by panel screens.

BACKGROUND OF THE INVENTION

In open-plan offices, it is common practice to separate individual workstations by panel screens from which shelves or worksurfaces carrying equipment such as computers are mounted. Conventionally, cables connecting the equipment on the worksurfaces to main services such as telephone lines or electric power run in the bottom of the panels and up through the panels to connectors behind a flip-up panel at worksurface height.

Such conventional constructions suffer from a number of disadvantages, most notably, inflexibility in that to rearrange or relocate the workstation it is necessary to dismantle it by removing worksurfaces and equipment to obtain access to the cabling within the panel screens. Also, as the workstation surfaces are attached to the panel screens, to modify or repair the cabling for one operator will usually result in disturbing other operators in the same installation.

SUMMARY OF THE INVENTION

The present invention aims to provide a modular furniture system which does not suffer from the disadvantages of prior art systems.

According to the invention there is provided a modular furniture system for open-plan offices comprising a cable tower unit, a plurality of panel screens, said panel screens being attachable to and detachable from said cable tower unit, adjacent ones of said panel screens defining a workstation area when attached to said cable tower unit, and a workstation surface moveable into and out of said workstation area, said workstation surface being free-standing from said cable tower unit and said panel screens.

A system embodying the invention may have a number of advantages. Most notably, the problems in relocating or servicing the cabling due to poor access to the cabling are overcome by the present invention as the worksurfaces are not mounted from the panel screens, thereby enabling one workstation to be moved without disturbing others. Also, the access to cabling and the volume of cabling the system is able to take is improved as cabling is contained in a central column to which an individual's equipment is connectable.

Embodiments of type invention will now be described by way of example and with reference to the accompanying drawings.

DETAILED DESCRIPTION OF THE PREFERRED EMBODIMENTS

Figure 1:
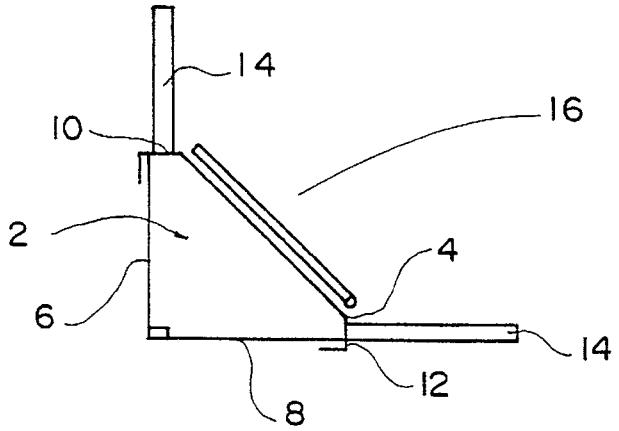
FIG. 1 is a plan view of a first embodiment of a modular furniture system according to the invention.

FIG. 1 shows a first embodiment of the invention comprising a single workstation cable tower unit 2 having a workstation face 4 and two rear faces 6,8 orthogonal to each other, the tower unit 2 having an essentially triangular cross-section. The two rear faces 6 and 8 are connected to the workstation face 4 through mating surfaces 10,12 parallel to the appropriate opposite rear face of the tower. Panel screens 14 are attachable to the mating surfaces 10,12 of the tower to define a workstation area 16 adjacent the workstation face 4. The panel screens 14 are attached to the cable tower unit 2 by, for example, bolts protruding from the mating surface of the panel screen 14 which pass through holes in the mating face of the tower unit and are secured in position by bolts inside the tower unit 2 (not shown).

Figure 2A:
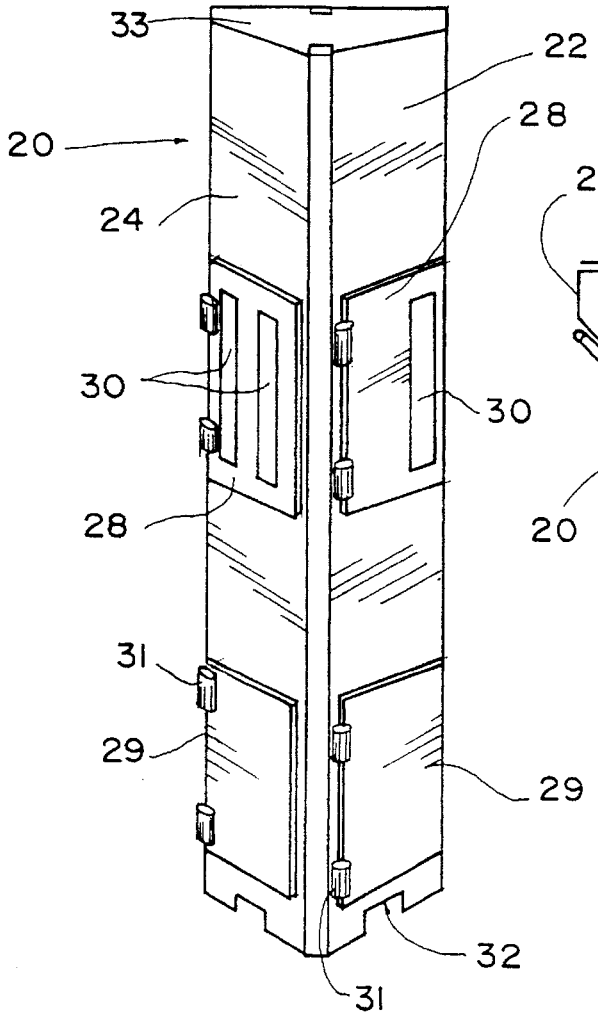
FIG. 2*a* is a perspective view from above and one side of a cable tower unit of a second embodiment of the invention.
Figure 2B:
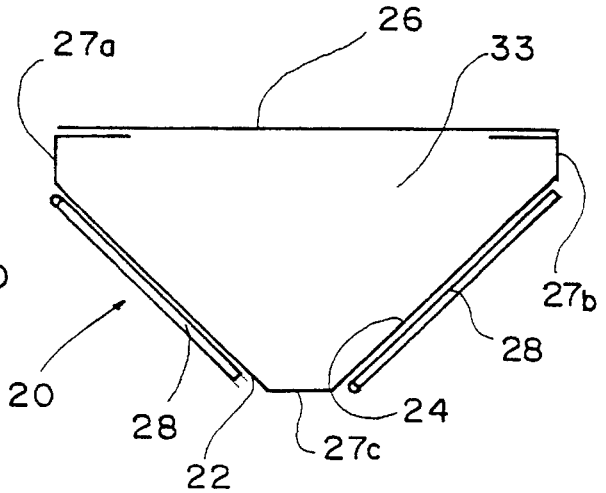
FIG. 2*b* is a plan view of the cable tower unit of FIG. 2*a;*

In a second embodiment of the invention shown in FIGS. 2*a* and 2*b*, the cable tower unit 20 differs from that shown in FIG. 1 in that it is a two-workstation cluster and comprises two workstation faces 22 and 24 and a rear face 26. The two workstation faces 22 and 24 are orthogonal to each other and are connected to each other and the rear face 26 by mating surfaces 27*a,b,c* to which first, second and third panel screens of the type shown in FIG. 1 may be attached.

Each workstation face 22 and 24 includes an upper and a lower door 28 and 29 mounted thereon. The doors can have one or more strips of connector panels 30 for carrying power and/or telecommunication services to the equipment of the workstation or alternatively they can have a plane face not including connectors. The power points can conveniently be connected to floor boxes in the office in which the cable tower unit is situated. The doors are fitted to the cable tower unit by means of lift-off hinges 31 thereby enabling the doors to be easily changed to suit the workstation environment.

The lower end of the workstation faces 22,24 of the tower unit 20 and the floor of the tower unit (not shown) include cable recesses 32 to allow the ingress of cables. The top of the tower unit 20 is preferably closed by a lid 33 onto which, for example, an uplighter may be mounted.

Figure 3:
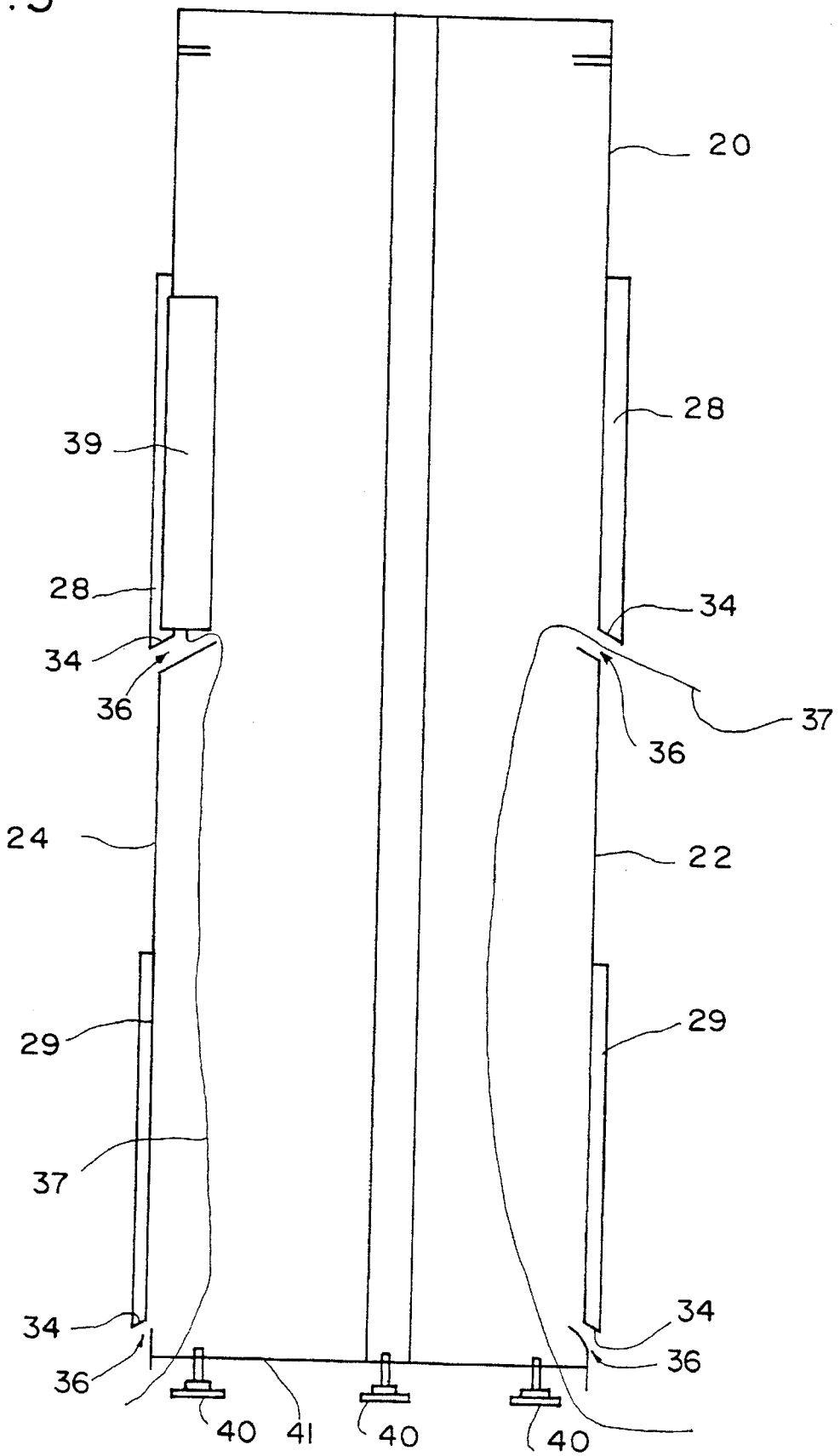
FIG. 3 is a cross-sectional view through the rear face of the cable tower unit of FIGS. 2*a* and 2*b;*

FIG. 3 shows the interior of the cable tower unit 20 of FIGS. 2*a* and 2*b*. The lower edges of the doors 28, 29 on each workstation face 22 and 24 are bevelled to form, with a corresponding lip 34 on the door 28,29, an inclined channel 36 through which cables 37 may be passed to a connector 39 mounted on the inner surface of the door 28 or passed through the channel directly to equipment on the workstation surface. As the cables are contained in the channel, it is possible to close the door with the cables in place without distorting the cables. This has the advantage also that the door can be locked with the cabling in place to prevent unauthorised access to the connectors when mounted on the inner surface of the door.

A number of feet 40 which may be height adjustable, are attached to the bottom surface 41 of the cable tower unit.

Figure 4:
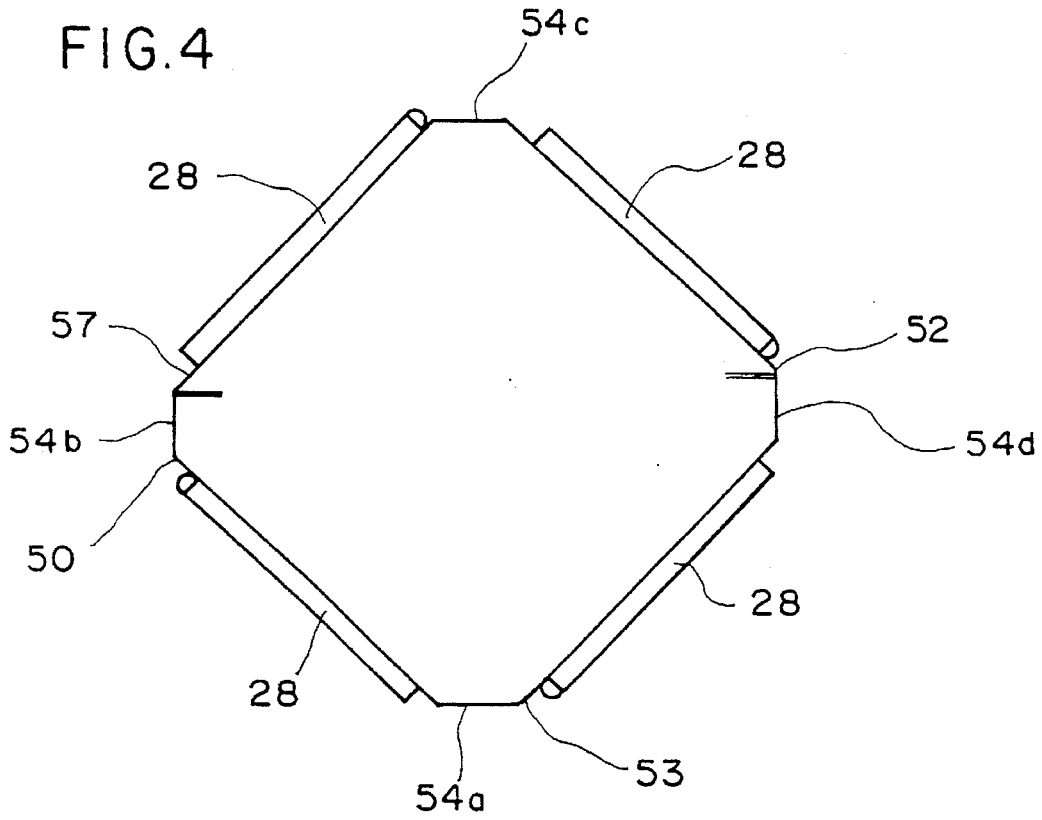
FIG. 4 is a plan view of a cable tower unit of a third embodiment of the invention.
Figure 5:
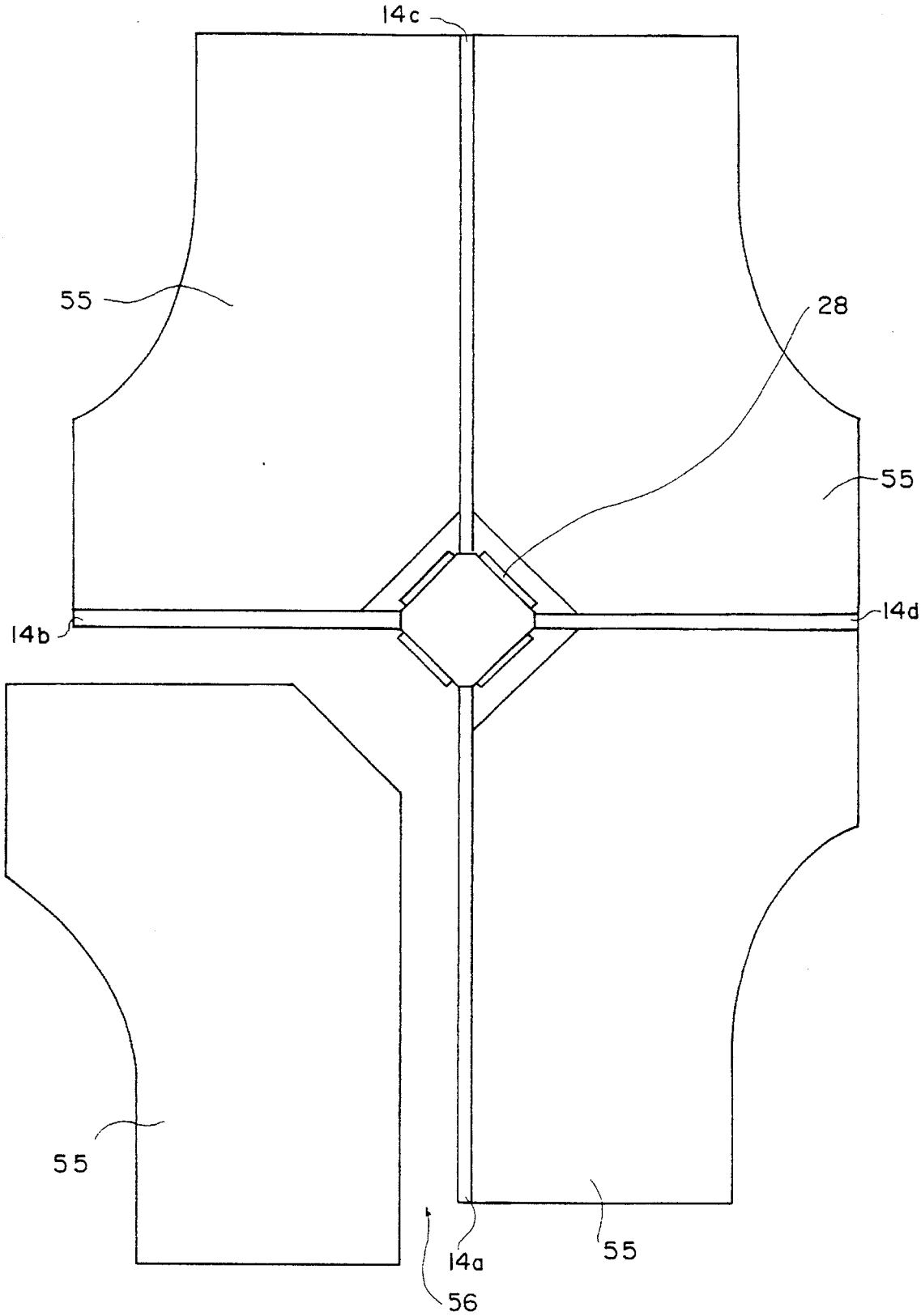
FIG. 5 is a plan view of the modular furniture system including the cable tower unit of FIG. 4.

FIG. 4 shows a third embodiment of the invention which differs from embodiments shown in FIGS. 1 to 3 in that it comprises four workstations faces 50,51,52 and 53 each face being orthogonal to its two adjacent faces and connected thereto via a mating face 54*a,b,c,d* to which panel screens 14*a,b,c,d* may be attached, as shown in FIG. 5. Free-standing workstation surfaces 55 may be positioned in the workstation area 56 defined by two adjacent panel screens 14*a* and 14*b*, 14*b* and 14*c*, 14*c* and 14*d*, and 14*d* and 14*a*, as shown in FIG. 5.

Figure 6A:
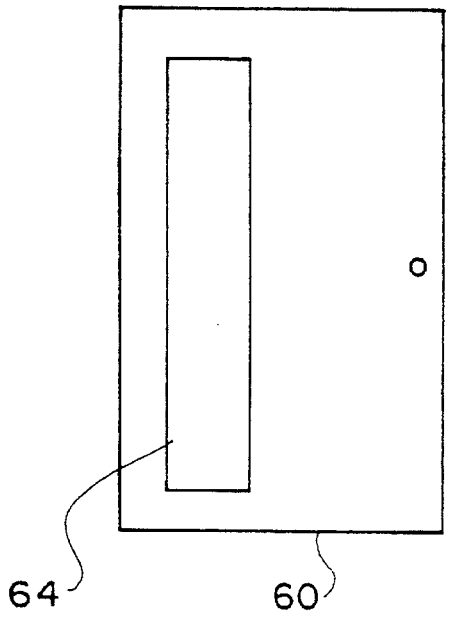
FIG. 6*a* is a front elevation of a door mountable on the cable tower units of any of FIGS. 1 to 5.
Figure 6B:
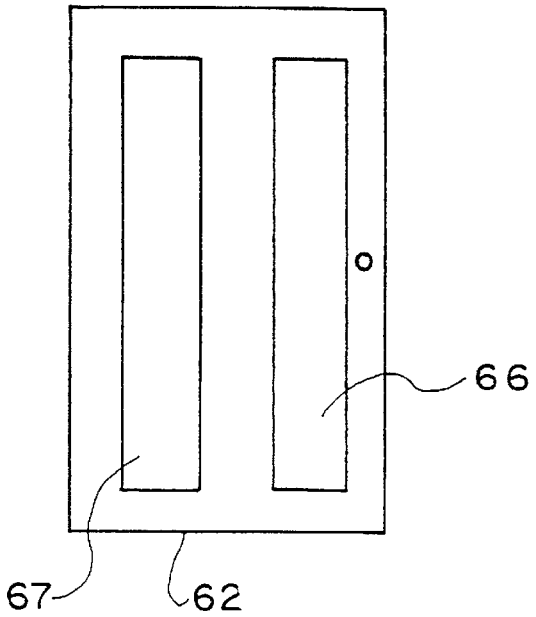
FIG. 6*b* is a front elevation of an alternative cable tower unit door.

FIGS. 6*a* and 6*b* show alternative door fascias 60,62 to be mounted on the cable tower units of any of the three embodiments of the invention described. FIG. 6*a* shows a door fascia 60 having a single connector strip 64 accessible from its outer surface. FIG. 6*b* shows a door fascia having two connector strips 66,67.

Figure 7A:
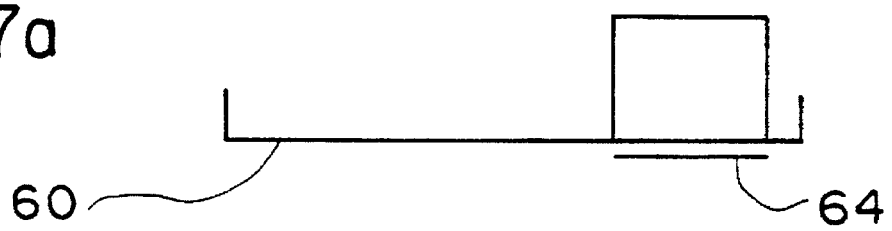
FIGS. 7*a*, 7*b* and 7*c* are plan views of alternative cable tower unit doors.
Figure 7B:
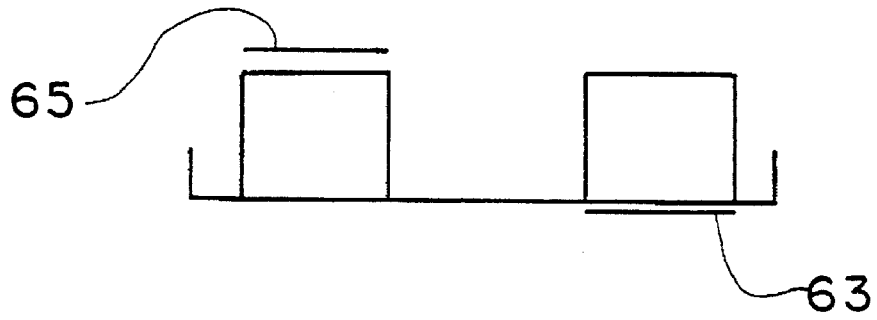
Figure 7C:
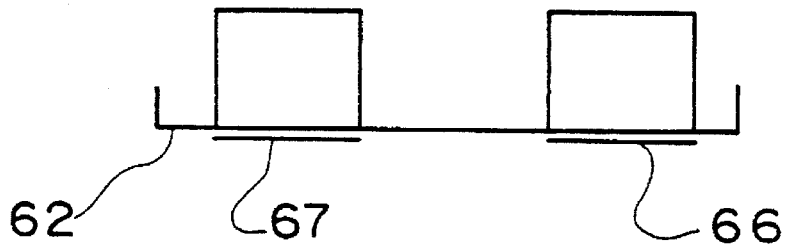

FIGS. 7*a,b* and *c* show alternative configurations of the connector strips of FIGS. 6*a* and 6*b* mounted in the doors 60,62 for use in any of the three embodiments of the invention described. FIG. 7*a* shows a single strip 64 accessible from outside the tower. FIG. 7*b* shows two strips 63,65, one 65 accessible internally and the other 63 from outside the tower. FIG. 7*c* shows two connector strips 66,67 both externally accessible.

In any of the three embodiments of the invention, a free-standing worksurface 55 may be positioned in the area 16;56 defined between the two adjacent panel screens 14*a, b,c,d* to form a workstation. Equipment, for example computers, may be positioned on the worksurfaces and connected to cables 37 in the cable tower unit 2;20, either through the connector strips 63;64;65;66;67 mounted in the doors 28,29 of the tower unit 2;20 or, alternatively, directly via cables passing through the channel 36 formed below the doors 28,29, in which case the cables 37 are unaffected by opening or closing of the doors 28,29. The cables 37 are fed into the cable tower unit 2;20 from, for example, a floor box through a notch 32 in the base of the tower unit 2;20. In an alternative embodiment, the cables 37 may be fed into the tower unit 2;20 from above (not shown), through the top of the tower unit. Alternatively, the cables 37 may run along access channels (not shown) in the panel screens and into the tower unit 2,20 in any of the aforementioned ways.

Thus, the system illustrated provides a versatile system of workstations in which worksurfaces,being free-standing, can be removed from the workstation area to allow instant access to the cable tower unit and rear of the equipment hardware. It also provides a system in which the cable tower unit can easily be detached from the services and panel screens so that it may be moved to another location without disruption to other workstation clusters. Also, where suitable, the tower unit may be supplied pre-wired for easy installation or installed on site for wiring by cabling engineers before the worksurfaces or other furniture and equipment is installed.

Furthermore, in a preferred embodiment the need for intermediate power or data/voice connectors is eliminated as the services may be connected directly to the equipment by passing through channels under the doors mounted on the cable tower unit.

It will be appreciated that various modifications may be made, for example, it is possible to construct a workstation embodying the invention comprising a 3 or 5 workstation cluster rather than the single, double or quadruple cluster workstations described, having 3 or 5 workstation faces respectively.

I claim:

1. A modular furniture system for open-plan offices comprising first and second cable tower units for forming with one or more panel screens a workstation area in an open space, each of said first and second cable tower units comprising at least one workstation face, adjacent said workstation area, said workstation face including one or more doors, said doors providing access through an aperture to power or telecommunications outlets from said workstation area, and each of said first and second cable tower units having a rear face, said rear face of said first cable tower unit being attachable to said rear face of said second cable tower unit to form four workstation areas.

2. A modular furniture system according to claim 1, comprising two panel screens attachable to and detachable from said cable tower units.

3. A modular furniture system according to claim 1, comprising three panel screens attachable to and detachable from said cable tower units.

4. A modular furniture system according to claim 1, comprising four or more panel screens attachable to and detachable from said cable tower units to form four workstation areas.

5. A modular furniture system according to claim 1, wherein said doors have a bevelled lower edge to correspond with a bevelled lower edge of said aperture, said bevelled edges defining an inclined channel when said doors are closed through which cables may be passed from the interior of each said cable tower unit to said workstation area.

6. A modular furniture system according to claim 5, wherein said doors ate mountable on and detachable from said workstation faces by means of lift-off hinges.

7. A modular furniture system according to claim 5, wherein said doors include one or more panels of connectors to enable equipment on said workstation surface to be connected to incoming cables.

8. A modular furniture system according to claim 7, wherein one or more of said panels of connectors are facing outwards from said workstation faces onto which said door housing said panel of connectors is mounted, said connectors being accessible from said workstation area.

9. A modular furniture system for open-plan offices according to claim 1, wherein said rear face of said first cable tower unit is detachable from said rear face of said second cable tower unit.

10. A modular furniture system according to claim 9, wherein said first and second cable tower units comprise four workstation faces.

11. A modular furniture system according to claim 9, wherein said doors include one or more panels of connectors to enable equipment on a workstation surface to be connected to incoming cables.

12. A modular furniture system according to claim 9, wherein one or more panels of connectors are facing outwards from and mounted on said workstation faces, said connectors being accessible from said workstation area.

* * * * *